United States Patent [19]

Allgaier et al.

[11] Patent Number: 4,860,268

[45] Date of Patent: Aug. 22, 1989

[54] AUTONOMOUS RADIO TIMEPIECE

[75] Inventors: Jürgen Allgaier, Lauterbach; Wolfgang Ganter, Schramberg-Sulgen; Wolfram Hodapp, Rottweil; Arthur Kopf, Schramberg; Roland Maurer, Lauterbach, all of Fed. Rep. of Germany

[73] Assignee: Junghans Uhren GmbH, Schramberg, Fed. Rep. of Germany

[21] Appl. No.: 241,238

[22] Filed: Sep. 7, 1988

[30] Foreign Application Priority Data

Sep. 23, 1987 [DE] Fed. Rep. of Germany ... 8712803[U]

[51] Int. Cl.[4] ..... G04C 11/02

[52] U.S. Cl. ..... 368/47

[58] Field of Search ..... 368/46–47, 368/184–187; 455/12

[56] References Cited

U.S. PATENT DOCUMENTS

| | | | |
|---|---|---|---|
| 3,530,663 | 9/1970 | Marti | 368/47 |
| 3,881,310 | 5/1975 | Gerum et al. | 368/47 |
| 4,501,502 | 2/1985 | Van Orsdel | 368/47 |
| 4,645,357 | 2/1981 | Allgaier et al. | 368/46 |
| 4,650,344 | 3/1987 | Allgaier et al. | 368/47 |

*Primary Examiner*—Vit W. Miska

*Attorney, Agent, or Firm*—Burns, Doane, Swecker & Mathis

[57] ABSTRACT

An autonomous radio timepiece having a time equalizing processor to control and potentially correct the instantaneous time indication on the basis of the prevailing time information received by radio transmission, is equipped with an improved device for temporarily interrupting operation of the time indication. Such a device is provided for the purpose of interrupting the display function of the radio timepiece without deactivating the other auxiliary and operating functions of the radio timepiece, so that following termination of the interruption, normal operation continues without any interference. The display may be interrupted indirectly or directly. In the first case the reset inlet of the time equalizing processor is actuated to trigger the synchronizing process, which otherwise takes place upon the actuation of the radio timepiece. In the other case, the actuation of the display indexing device is electrically blocked in order to temporarily retain a predefined, just attained position of the gear (for example, to provide sufficient time to mount the hands of the display device during assembly of the radio timepiece).

9 Claims, 1 Drawing Sheet

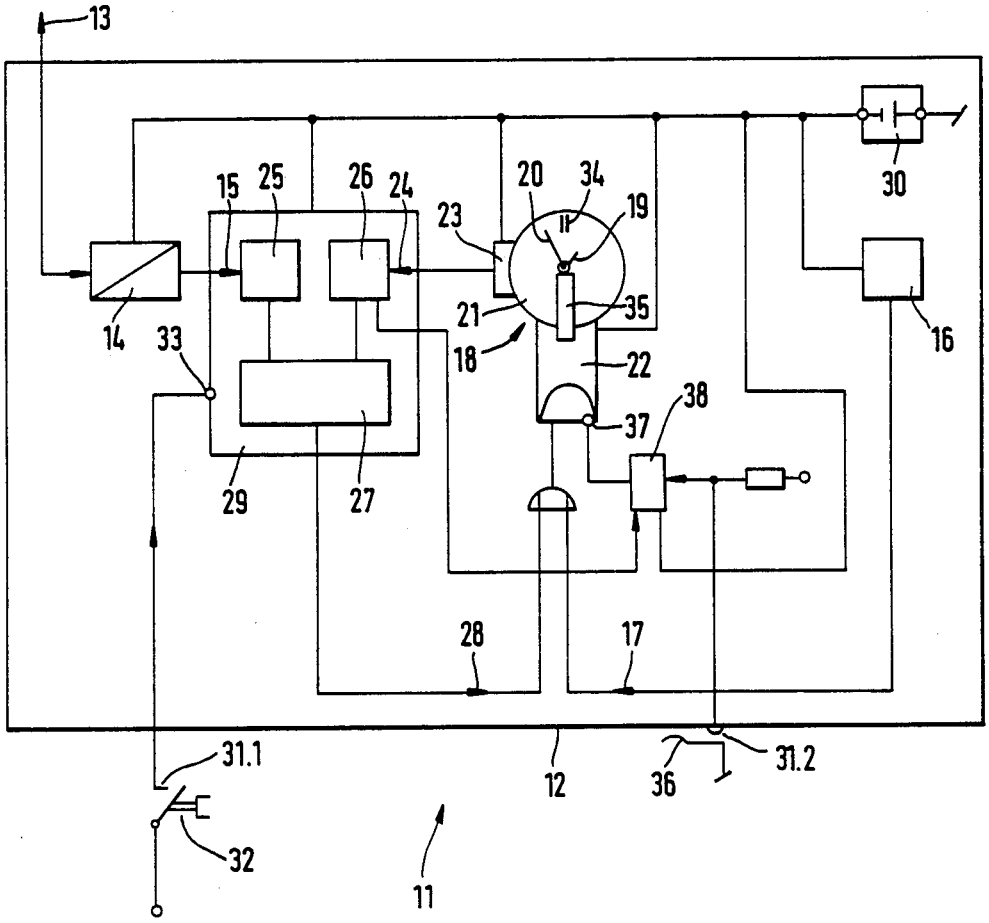
13
15
25
26
24
20
34
19
23
30
14
33
21
35
18
22
16
38
37
29
27
28
17
31.1
12
36
31.2
32
11

AUTONOMOUS RADIO TIMEPIECE

BACKGROUND OF THE INVENTION

The invention relates to an autonomous radio timepiece. More specifically, the invention relates to an autonomous radio timepiece having a receiver demodulator, a time equalizing processor for the correction of the prevailing time indication provided by a time display mechanism in case of a deviation from the actual time information received by radio transmission, an interrupting contact for the initiation of the time equalization following an interruption of the time indication, a time keeping circuit and an indexing device for the time indication.

An autonomous radio timepiece is known from U.S. Pat. No. 4,650,344 and in particular, the determination of the position of the time display mechanism for comparison with the instantaneous time information received by radio transmission is known from U.S. Pat. No. 4, 645,357. In the case of a radio timepiece of this generic type marketed by the present applicant, the power supply (i.e., a dry battery) is connected by means of a power supply switch. Actual practice has shown that there is a strong need on the side of consumers to actuate this power switch during the operation of the radio timepiece in order to briefly interrupt operation and thus create a divergence between the instantaneous time indication provided by the time display mechanism and the actual time information, and then to trigger the internal, automatically controlled indication comparison process by reactuating the supply. Such a practice is desirable either for personal satisfaction that the time display resulting from the preceding autonomous operating phase actually corresponded to the instantaneous time information received by radio transmission, or merely to demonstrate the operating behavior of such a radio timepiece. However, any interruption of the operation by disconnecting the power supply is disadvantageous because upon reactuation, the control circuit of the radio receiver and the internal processor regulation must enter their stationary operating states, whereby brief interruptions of the power supply may well lead to the self-blocking of the processor due to the irregular progress of the initiation process.

In view of these conditions, it is an object of the present invention to make interruptions of the operation of a radio timepiece possible for the above mentioned or other reasons, without causing extended run-in intervals or functional problems.

SUMMARY OF THE INVENTION

In accordance with the present invention, an autonomous radio timepiece having a time equalizing processor to control and potentially correct the instantaneous time indication provided by a time display mechanism on the basis of prevailing time information received by radio transmission is equipped with improved means for temporarily interrupting operation of the display mechanism. More specifically, an interrupting contact for the electrical blockage of the detection and the actuation of the time indication which will not otherwise interrupt the operation of the radio timepiece is disclosed.

According to this solution, only the indexing of the time display is interrupted, while maintaining the operation of the functional parts of the radio timepiece, thereby creating a divergence between the actual time and the (arrested) time display, which is then equalized in the usual manner (after the termination of the interference) by the time equalizing processor. This interruption of the display may take place indirectly or directly. Indirect display interruptions are preferably realized by supplying the time equalizing processor with misinformation concerning the actual instantaneous point in time and/or the instantaneous time display. For example, this may be effected in the simplest manner by actuating the normal processor reset, thereby triggering time equalization from an initial position. In the case of a direct interruption, the electric actuation of an indexing means for the time display may be temporarily blocked electrically by means of an inhibiting circuit, thereby creating a divergence between the actual time and the time indicated. As soon as this blockage is eliminated, the operating mode of the time equalizing processor again leads to a correction of the time indication.

BRIEF DESCRIPTION OF THE DRAWINGS

Other objects and advantages of the present invention will become apparent from the following detailed description of preferred embodiments as described in conjunction with the accompanying drawing in which:

The single Figure shows an autonomous timepiece with two independently actuable interruption connections for the discontinuation of the continuous time indication.

DETAILED DESCRIPTION OF THE PREFERRED EMBODIMENTS

The radio timepiece 11 outlined in the Figure contains in its works case 12 a receiver-demodulator 14 supplied by means of an antenna 13 with high frequency power, to obtain coded, instantaneous time information on the line 15. An autonomous, preferably quartz stabilized time keeping circuit 16 provides indexing time pulses on a line 17 for a time display device 18, which preferably is in the form of a hand display having an hour hand 19 and a minute hand 20 (and also potentially having a second hand, not shown), in front of a minute display 21, and operated by means of an indexing device 22—preferably in the form of a stepping motor with operational reduction of the hand movement. A display detection device 23 (for example an angle decoder to determine the instantaneous position of the hands 19, 20 or an end position coder to yield information concerning the passage of the hand through a predetermined position) provides instantaneous display information on the line 24. The information on the lines 15, 24 is input to the decoding converters 25, 26 whereby they are represented in a manner such that they may be evaluated in a time equalization comparator 27 in relation to each other in order to supply correction pulses on the line 28 to the indexing device 22 in the case of an instantaneous misindication (relative to the actual instantaneous time information on the line 15), until the detected time indication on the line 24 is again coincident with the actual time information on the line 15.

The converters 25, 26 and the comparator 27 are located in a time equalization processor 29. In actual practice, the time equalization processor 29 may also perform decoding functions of the detection device 23 although this is not shown in the drawing for the sake of clarity.

The operating parts of the radio timepiece 11 are supplied by a power source 30, such as a secondary battery or the storage means of a primary power generator (solar cell, thermal cell or the like).

To be able to determine whether the time equalization means is operating properly or to demonstrate the time equalization function, an interruption connection which includes an interruption contact 31.1 is provided, whereby—for example by means of a manually actuated push button switch 32—the reset inlet 33 of the processor 29 may be actuated. This places the processor 29 into its initial operating state, which corresponds to its state during the startup of the radio timepiece 11 wherein it cannot be assumed that the random instantaneous position of the hands 19, 20 of the time indication corresponds to the actual time information on the line 15 which is receivable by radio transmission. For this reason, the processor 29 initially causes the hands 19, 20 to move into a defined initial position, preferably the zero hour position 34 (indicated in the drawing on the minute display 21 by a double mark). During the movement into said position or upon the attainment of this position 34, the desired display position according to the prevailing instantaneous time information is determined in the comparator 27 and thereupon the time display is corrected by supplying an indexing device 22 with correcting pulses via the line 28.

If the display detection device 23 determines the position of the hands 19, 20 not directly, but only indirectly, i.e. by means of certain gear positions in the gear connection with the indexing device 22, care must be taken during the mounting of the hands to insure that the instantaneous hand setting is in agreement with the associated gear position. In watch manufacturing it is customary to set the hands in the zero hour or initial position 34 during assembly.

In the case of the radio timepiece 11 this is the position into which the gear works is rotated by the indexing device 22 and this position serves as the initial position for the operation of the time equalizing processor 29. Upon the actuation of the radio timepiece 11 (following the actuation of the interrupting contact 31.1) a gear 35 is thus initially moved into th ®position corresponding to the initial position 34 of the time display device 18. When the display detection device 23 coupled with the gear 35 signals the attainment of this initial position 34, the drive of the gear 35 is briefly halted, in order to be subsequently moved by means of the correction pulses on the line 28 into the display position corresponding to the actual instantaneous time information provided on the line 15.

However, this brief halting of the gear 35 in the defined initial position 34 does not provide a sufficient period of time as required for the manual or semiautomatic mounting of the hands 19, 20 on the display during assembly of the radio timepiece. To extend this holding period to the length required for the mounting of the hands, the interruption connection includes another interrupting contact 31.2 which is provided on the case 12. The latter contact is preferably mounted as a counter contact so that it may be reached by a contact rail 36 when the case 12 is being displaced on a mounting belt in the course of its assembly.

If therefore the case 12, which is not as yet equipped with the hands 10, 20 but which is capable of operation, is provided with its power source 30 while on the assembly belt, i.e. actuated for the first time, th gear 35 is initially (as described above) moved into its initial position which corresponds to the initial display position 34 by the processor 29. To provide time for the mounting of the hands, i.e. so that the gear 35 is not rotated immediately into the position corresponding to the instantaneous time information provided on the line 15, the case 12 is moved onto the contact rail 36. An inhibit inlet 37 is thereby actuated by means of the interrupting contact 31.2 in the course of the activation of the indexing device 22 (shown in the drawing for the sake of simplicity adjacent to the indexing device, but capable of location in the processor 29), in order to temporarily retain the gear 35 in the initial position 34 just attained, and to permit the hands 19, 20 to be mounted in this initial position (zero hour). Following the mounting of the hands, the case 12 is slid or lifted off the contact rail 36, the actuation blockage through the inhibit inlet 37 is released, and the gear 35 with the hands 19, 20 is rotated by means of the correction pulses on the line 28 into the angular position corresponding to the actual time information.

In place of the contact rail 36, the actuation of the interrupting contact 31.2 may also be effected by means of an additional switch mounted on the case 12, or by means of a conducting bridge (not shown) established manually during assembly and removed.

So as not to miss the point in time corresponding to the initial movement of the gear 35 into the initial position 34 during the shifting of the case 12 on the assembly line (and then having to await another complete 12-hour revolution), it is possible to additionally actuate the inhibit inlet 37 by means of a memory circuit 38 (which in contrast to the simplified circuit diagram, is preferably included within the processor 29). This memory circuit 38 is prepared (only) during the actuation of the power supply 30 and is set over the display information line 24, when the gear 35 has attained a position corresponding to the initial position 34 for the first time. The indexing device 22 is now electrically blocked and a period of time of arbitrary length is available for the mounting of the hands. When this is completed, the case 12 is further displaced for example over the contact rail 36 and then the operation of the memory circuit 38 interrupted by the actuation of the interrupting contact 31.2—until the next interruption and reappearance of the power supply—so that in the future normal operation of the radio timepiece, the attainment of the initial position 34 or an accidental actuation of the interrupting contact 31.2 will have no effect on the inhibit inlet 37 for the operation of the indexing device 22.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. An autonomous radio timepiece comprising:

a receiver-demodulator;

a time equalizing processor for providing time equalization in the radio timepiece by correcting a prevailing time indication when such an indication deviates from time information received by radio transmission;

a time keeping circuit;

an indexing device for adjusting the time indication; and an interrupting connection for initiating the time equalization following an interruption of the time indication and for electrically blocking actuation of the time indication without otherwise interrupting operation of the radio timepiece.

2. A radio timepiece according to claim 1, wherein the interrupting connection includes an interrupting contact which is carried on a reset inlet of the processor.

3. A radio timepiece according to claim 1, wherein said interrupting connection includes an interrupting contact which is carried on an inhibit inlet of the indexing device.

4. A radio timepiece according to claim 3, wherein the interrupting contact places one pole of a power supply on the inhibit inlet.

5. A radio timepiece according to claim 4, wherein the radio timepiece is located within a works case, and said interrupting contact is located externally on the works case so as to be accessible to a contact rail.

6. A radio timepiece according to claim 5, wherein the interrupting contact is mounted as a counter contact for an assembly contact rail in an accessible manner on the works case.

7. A radio timepiece according to claim 3, wherein the interrupting contact is conductively connected through a memory circuit to the indexing device.

8. A radio timepiece according to claim 7, wherein the memory circuit is prepared during startup of the radio timepiece by means of a power supply and deactivated by means of the interrupting contact.

9. A radio timepiece according to claim 3, wherein the interrupting connection includes another interrupting contact which is carried on a reset inlet of the processor.

* * * * *